US010166659B2

(12) United States Patent
Chou

(10) Patent No.: US 10,166,659 B2
(45) Date of Patent: Jan. 1, 2019

(54) RATCHET WRENCH

(71) Applicant: Chin-Ying Chou, Taichung (TW)

(72) Inventor: Chin-Ying Chou, Taichung (TW)

(73) Assignee: Powagrip Industrial Co. Ltd., Taichung (TW)

( * ) Notice: Subject to any disclaimer, the term of this patent is extended or adjusted under 35 U.S.C. 154(b) by 204 days.

(21) Appl. No.: 15/370,362

(22) Filed: Dec. 6, 2016

(65) Prior Publication Data

US 2017/0182642 A1 Jun. 29, 2017

(51) Int. Cl.
*B25B 23/00* (2006.01)
*B25B 13/46* (2006.01)

(52) U.S. Cl.
CPC ..... *B25B 23/0035* (2013.01); *B25B 13/465* (2013.01)

(58) Field of Classification Search
CPC . B25B 23/0035; B25B 13/465; B25B 13/463; B25B 15/04; B25B 13/468
See application file for complete search history.

(56) References Cited

U.S. PATENT DOCUMENTS 6,076,433 A * 6/2000 Lynch ..... B25B 13/463 81/60
6,752,046 B1 * 6/2004 Lee ..... B25B 13/461 81/177.85
2003/0177872 A1 * 9/2003 Shu-Ying ..... B25B 13/463 81/63.2
2010/0326247 A1 * 12/2010 Chu ..... B25B 13/463 81/63.1

* cited by examiner

*Primary Examiner* — Robert Scruggs
(74) *Attorney, Agent, or Firm* — Che-Yang Chen; Law offices of Scott Warmuth

(57) ABSTRACT

A ratchet wrench may comprise a main body, a circular ratchet gear, a locating unit, a spring and at least an accessory tool. The main body has an operating rod and a head portion, and an operating hole penetrates through a central portion of the head portion. Also, the ratchet gear is installed inside the operating hole. The locating unit is configured to extend toward an interior of the operating hole through an engaging portion thereof, and a peripheral groove is located at an end of the accessory tool along an outer periphery thereof. By engaging the engaging portion of the locating unit with the peripheral groove of the accessory tool, the accessory tool inserted into the connecting hole is configured to be secured on the main body for operation.

5 Claims, 4 Drawing Sheets

A-A

RATCHET WRENCH

FIELD OF THE INVENTION

The present invention relates to a ratchet wrench, and more particularly to a ratchet wrench capable of firmly engaging with different accessory tools.

BACKGROUND OF THE INVENTION

Generally, a conventional ratchet wrench has a main body, and a driving portion and a ratchet piece are secured at a head end thereof. Also, a plurality of peripheral teeth are arranged along an outer periphery of the driving portion, and a locating unit is configured to press and allow the ratchet piece to engage with the peripheral teeth. Moreover, the ratchet wrench has a switching unit, and the ratchet piece has two different teeth portions at two sides thereof. Thus, the switching unit is configured to drive the ratchet piece to engage with peripheral teeth through either of two teeth portions, thereby completing the engaging process.

However, the conventional ratchet wrench is disadvantageous because: in actual application, an accessory tool is simply received in a polygonal hole of the driving portion, and there is no a locating unit to firmly secure the accessory tool on the ratchet wrench when operating. Thus, a user has to use one hand to hold the accessory tool, and use another hand to operate the ratchet wrench, which is inconvenient in operation. Therefore, there remains a need for a new and improved design for a ratchet wrench to overcome the problems presented above.

SUMMARY OF THE INVENTION

The present invention provides a ratchet wrench which comprises a main body, a circular ratchet gear, a locating unit, a spring and at least an accessory tool. The main body has an operating rod and a head portion, and a height of the head portion is slightly higher than the operating rod such that a stepped portion is formed therebetween. An operating hole penetrates through a central portion of the head portion, and the ratchet gear operated by a switching unit is installed inside the operating hole. Also, a surface of the stepped portion has a slot which is horizontally extended toward and communicated with the operating hole. Thus, the locating unit is configured to extend toward an interior of the operating hole after moved into the slot through an engaging portion thereof. An upper surface of the head portion has a vertical connecting hole which is located close to a first lateral edge of the main body and communicated with the slot, and a bolt positioned on an upper surface of the operating rod is located close to a second lateral edge of the main body. The locating unit comprises a first end and a second end, and a width of the first end is smaller than the second end. Moreover, a pivotal hole is formed on the first end, and an elongated slot formed at a bottom portion of the locating unit is located close to the second end. The engaging portion is located at an edge of the locating unit between the first end and the second end, and a height of the engaging portion is smaller than other portions of the locating unit. The accessory tool is installed inside the ratchet gear of the main body such that when a user holding the operating rod turns the main body, the accessory tool is driven by the ratchet gear to achieve operation. Also, a peripheral groove is located at an end of the accessory tool along an outer periphery thereof.

Comparing with conventional ratchet wrench, the present invention is advantageous because: (i) by engaging the engaging portion of the locating unit with the peripheral groove of the accessory tool, the accessory tool inserted into the connecting hole is configured to be secured on the main body for operation; and (ii) the main body is configured to engage and cooperate with different accessory tools, which significantly improves the practicability of the ratchet wrench.

DETAILED DESCRIPTION OF THE INVENTION

Figure 1:
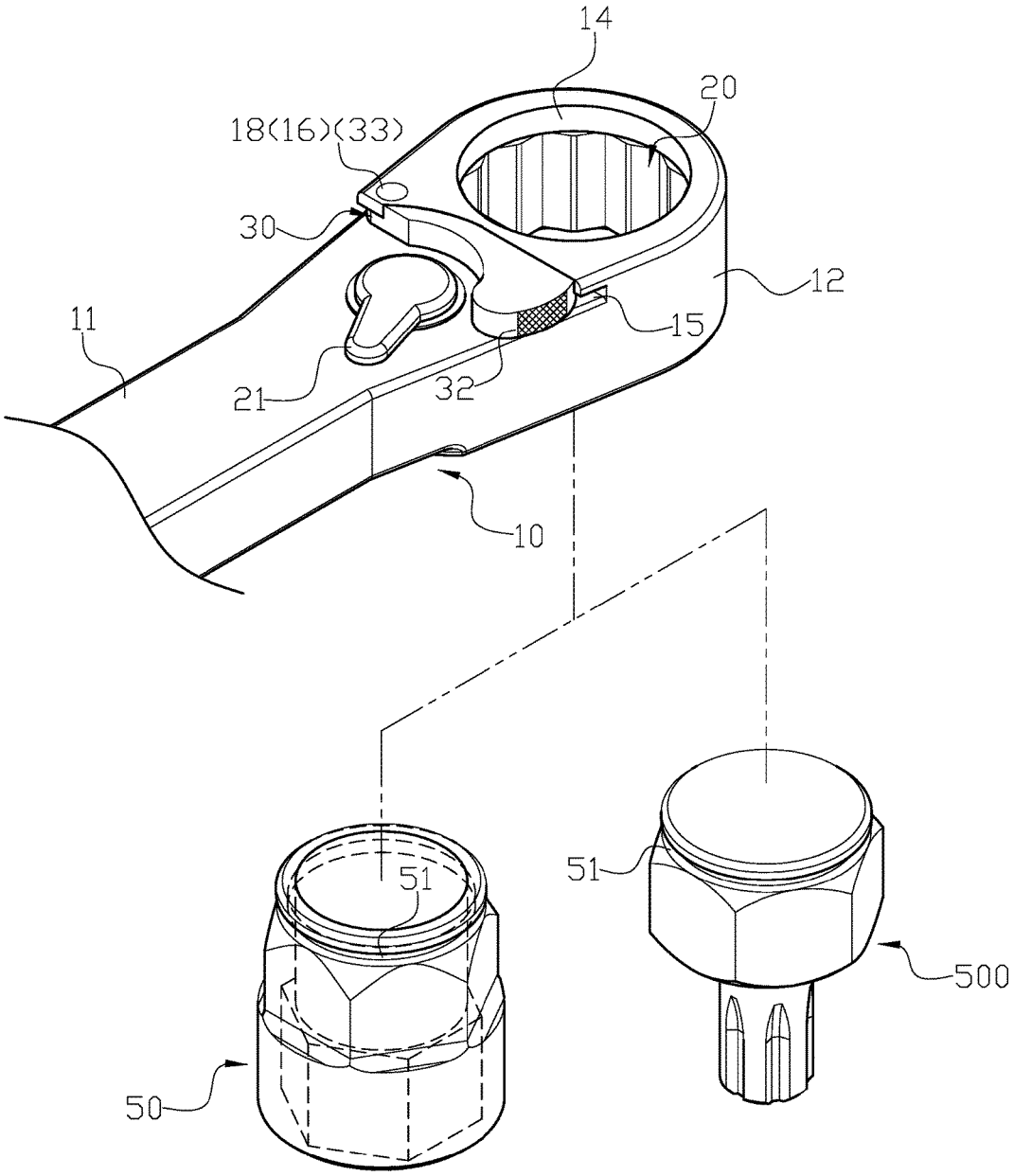
FIG. 1 is a three-dimensional assembly view of a ratchet wrench of the present invention.
Figure 2:
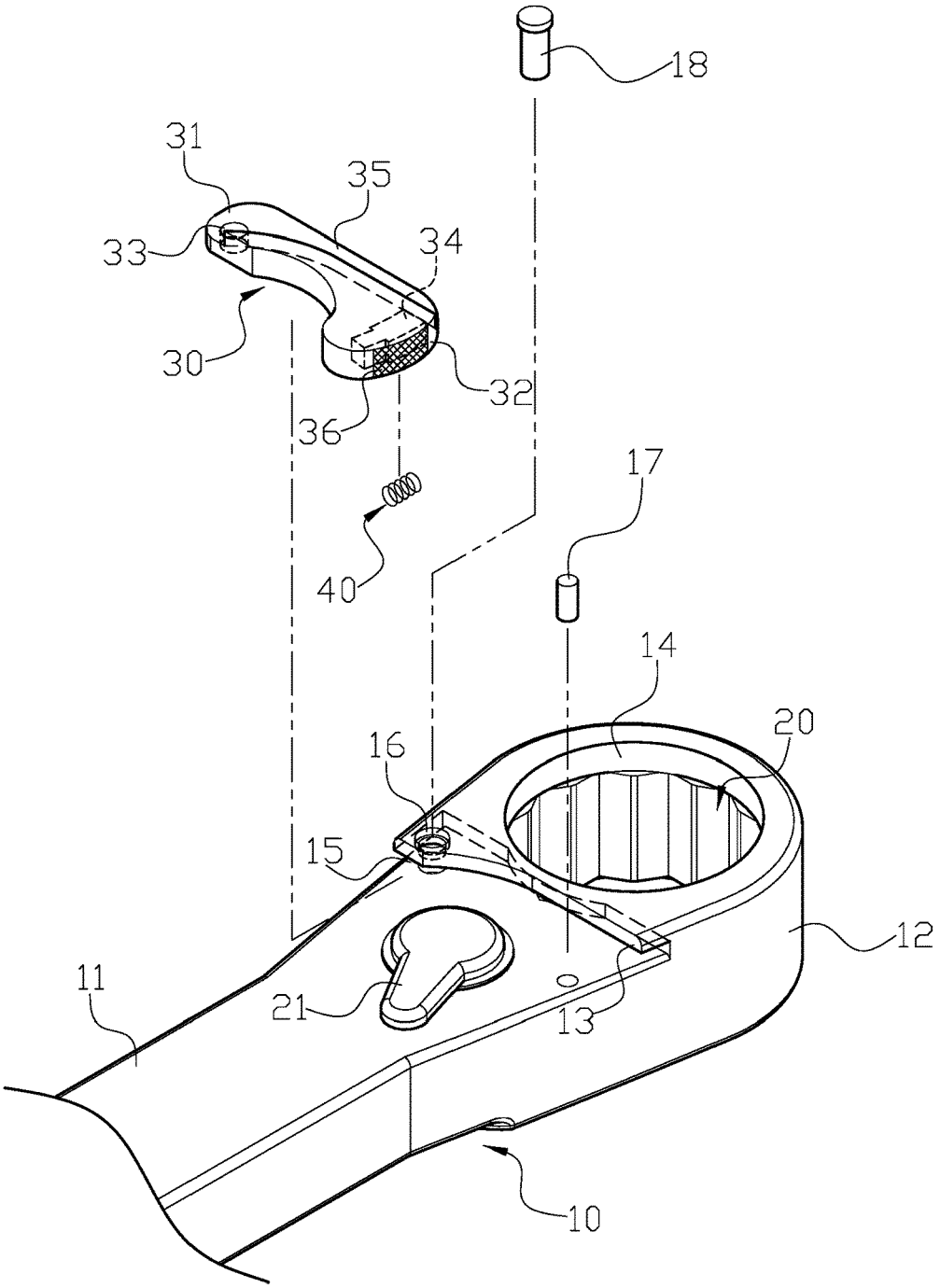
FIG. 2 is a three-dimensional exploded view of the ratchet wrench of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a ratchet wrench which comprises a main body (10), a circular ratchet gear (20), a locating unit (30), a spring (40) and at least an accessory tool (50)(500). The main body (10) has an operating rod (11) and a head portion (12), and a height of the head portion (12) is slightly higher than the operating rod (11) such that a stepped portion (13) is formed therebetween. An operating hole (14) penetrates through a central portion of the head portion (12), and the ratchet gear (20) operated by a switching unit (21) is installed inside the operating hole (14). Also, a surface of the stepped portion (13) has a slot (15) which is horizontally extended toward and communicated with the operating hole (14). Thus, the locating unit (30) is configured to extend toward an interior of the operating hole (14) after moved into the slot (15) through an engaging portion (35) thereof. An upper surface of the head portion (12) has a vertical connecting hole (16) which is located close to a first lateral edge of the main body (10) and communicated with the slot (15), and a bolt (17) positioned on an upper surface of the operating rod (11) is located close to a second lateral edge of the main body (10). The locating unit (30) comprises a first end (31) and a second end (32), and a width of the first end (31) is smaller than the second end (32). Moreover, a pivotal hole (33) is formed on the first end (31), and an elongated slot (34) formed at a bottom portion of the locating unit (30) is located close to the second end (32). The engaging portion (35) is located at an edge of the locating unit (30) between the first end (31) and the second end (32), and a height of the engaging portion (35) is smaller than other portions of the locating unit (30). The accessory tool (50)(500) is installed inside the ratchet gear (20) of the main body (10) such that when a user holding the operating rod (11) turns the main body (10), the accessory tool (50)(500) is driven by the ratchet gear (20) to achieve operation. Also, a peripheral groove (51) is located at an end of the accessory tool (50)(500) along an outer periphery thereof.

Figure 3:
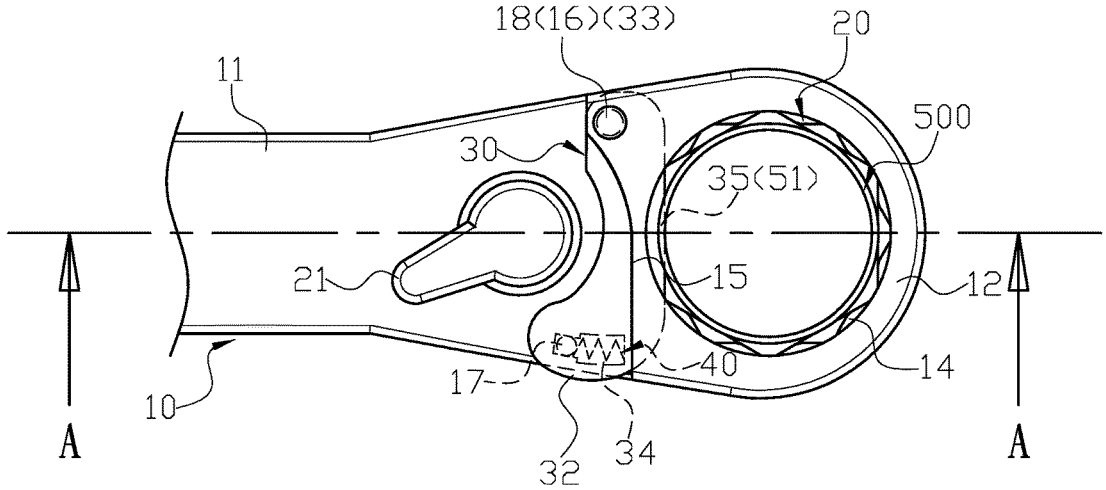
FIG. 3 is a schematic view illustrating a locating unit of the ratchet wrench secures an accessory tool on a main body of the ratchet wrench in the present invention.
Figure 4:
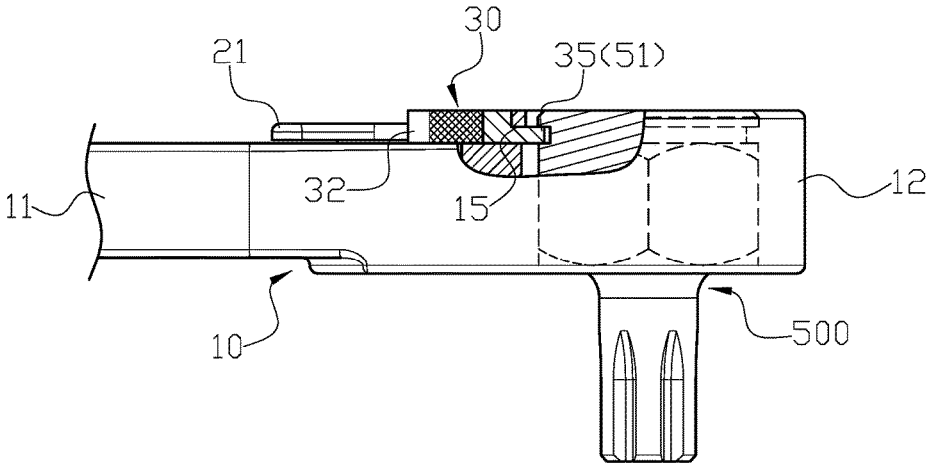
FIG. 4 is a sectional view of FIG. 3 along line A-A.

Structurally, referring to FIGS. 1, 3 and 4, the spring (40) is positioned inside the elongated slot (34) of the locating unit (30), and the pivotal hole (33) of the locating unit (30) is aligned with the connecting hole (16) of the main body (10) to allow a locating piece (18) to penetrate through both of the pivotal hole (33) and the connecting hole (16) such that the locating unit (30) is pivotally connected on the main body (10) and the engaging portion (35) of the locating unit (30) is positioned inside the slot (15). Thereafter, the bolt (17) positioned into the elongated slot (34) is configured to bear against an end of the spring (40) such that the spring (40) bearing against the locating unit (30) at another end thereof is configured to allow the engaging portion (35) of the locating unit (30) to extend toward the interior of the operating hole (14), thereby engaging with the peripheral groove (51) of the accessory tool (50)(500). As a result, the accessory tool (50)(500) is configured to be secured on the operating hole (14) of the main body (10) when operation.

In one embodiment, the second end (32) of the locating unit (30) has an anti-slip section (36) which is configured to allow the second end (32) to be operated easily.

In another embodiment, the accessory tool (50)(500) is an external sleeve.

In still another embodiment, the accessory tool (50)(500) is an external tool head.

Figure 5:
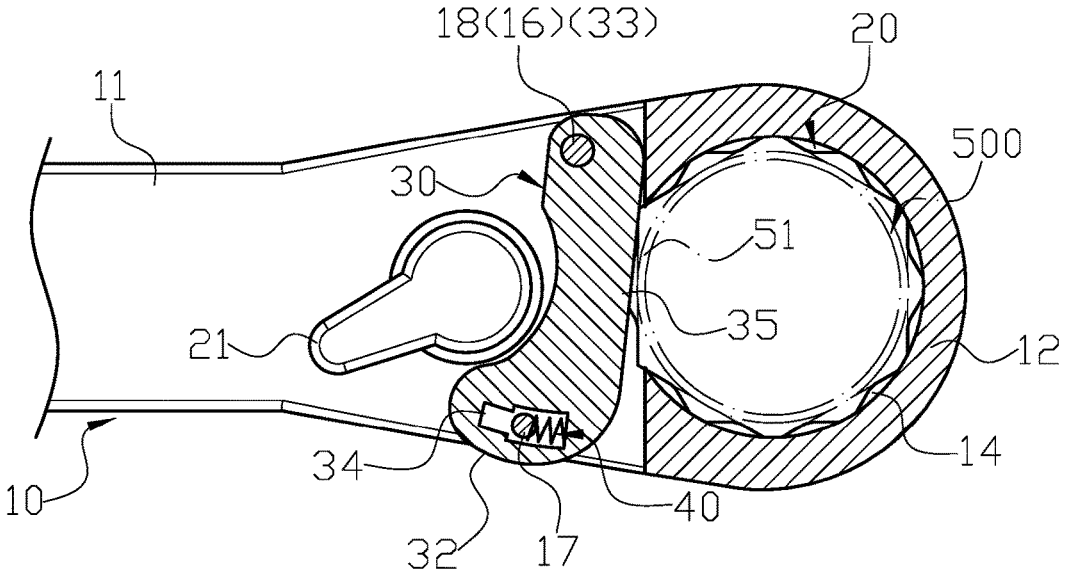
FIG. 5 is a schematic view illustrating the locating unit is disengaged with the accessory tool for replacing another accessory tool in the present invention.

In actual application, referring to FIG. 5, a user can easily replace the accessory tool (50)(500) secured in the connecting hole (14) by pulling the second end (32) of the locating unit (30). As a result the engaging portion (35) driven and moved away from the connecting hole (14) is disengaged with the peripheral groove (51) of the accessory tool (50)(500) such that the accessory tool (50)(500) is easily detached from the connecting hole (14) of the main body (10). After positioning another accessory tool (50)(500) into the connecting hole (14), the user can release the second end (32) of the locating unit (30), and the spring (40) bearing against the locating unit (30) is configured to allow the engaging portion (35) of the locating unit (30) to move back its initial position and engage with the peripheral groove (51) of the accessory tool (50)(500), thus securing the accessory tool (50)(500) on the main body (10) for operation.

Comparing with conventional ratchet wrench, the present invention is advantageous because: (i) by engaging the engaging portion (35) of the locating unit (30) with the peripheral groove (51) of the accessory tool (50)(500), the accessory tool (50)(500) inserted into the connecting hole (14) is configured to be secured on the main body (10) for operation; and (ii) the main body (10) is configured to engage and cooperate with different accessory tools (50)(500), which significantly improves the practicability of the ratchet wrench.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A ratchet wrench comprising:

a main body having an operating rod and a head portion, and a height of the head portion being slightly higher than the operating rod to form a stepped portion therebetween; an operating hole penetrating through a central portion of the head portion, and a ratchet gear, which is operated by a switching unit, installed inside the operating hole; a surface of the stepped portion having a slot which is horizontally extended toward and communicated with the operating hole, and after moved into the slot, a locating unit configured to extend toward an interior of the operating hole through an engaging portion thereof; an upper surface of the head portion, having a vertical connecting hole which is located close to a first lateral edge of the main body and communicated with the slot, and a bolt, which is positioned on an upper surface of the operating rod, located close to a second lateral edge of the main body;

the locating unit comprising a first end and a second end, and a pivotal hole formed on the first end, and an elongated slot, which is formed at a bottom portion of the locating unit, located close to the second end; the engaging portion located at an edge of the locating unit between the first end and the second end, and a height of the engaging portion being smaller than other portions of the locating unit;

at least an accessory tool installed in the ratchet gear of the main body, and by turning the operating rod, the accessory tool configured to be driven by the ratchet gear to achieve operation; a peripheral groove located at an end of the accessory tool along an outer periphery thereof; and a spring positioned inside the elongated slot of the locating unit, and the pivotal hole of the locating unit aligned with the connecting hole of the main body to allow a locating piece to penetrate through both of the pivotal hole and the connecting hole such that the locating unit pivotally connected on the main body and the engaging portion of the locating unit positioned inside the slot; the bolt, which is positioned into the elongated slot, configured to bear against an end of the spring such that the spring, which bears against the locating unit at another end thereof, configured to allow the engaging portion of the locating unit to extend toward the interior of the operating hole, thereby engaging with the peripheral groove of the accessory tool, and the accessory tool configured to be secured on the operating hole of the main body when operation.

2. The ratchet wrench of claim 1, wherein a width of the first end of the locating unit is smaller than the second end thereof.

3. The ratchet wrench of claim 1, wherein the second end of the locating unit has an anti-slip section.

4. The ratchet wrench of claim 1, wherein the accessory tool is an external sleeve.

5. The ratchet wrench of claim 1, wherein the accessory tool is an external tool head.

* * * * *